United States Patent [19]

Rotramel et al.

[11] 4,106,386

[45] Aug. 15, 1978

[54] MUSICAL STRINGED INSTRUMENT

[75] Inventors: Richard A. Rotramel, 2525 E. Peralta Way, Fresno, Calif. 93703; Charles Michael Fisher, Fresno, Calif.

[73] Assignee: Richard A. Rotramel, Fresno, Calif.

[21] Appl. No.: 747,500

[22] Filed: Dec. 6, 1976

[51] Int. Cl.[2] ..... G10C 1/00

[52] U.S. Cl. ..... 84/256; 84/10; 84/326

[58] Field of Search ..... 84/10–11, 84/256, 257, 285, 325, 326

[56] References Cited

U.S. PATENT DOCUMENTS

| | | | |
|---|---|---|---|
| 924,706 | 6/1909 | Warner | 84/256 |
| 1,229,122 | 6/1917 | Muse | 84/326 X |
| 1,741,948 | 12/1929 | Munger | 84/256 |

*Primary Examiner*—Lawrence R. Franklin
*Attorney, Agent, or Firm*—Huebner & Worrel

[57] ABSTRACT

A keyboard musical stringed instrument having a plurality of vibratory strings; a plurality of projections individually related to the strings and rotated by a powered drive in individual orbits for engagement of their respective strings, a plurality of supports individually mounting the projections for engagements with their respective strings to a depth and with a rapidity which produces sounds resembling those of a bowed stringed musical instrument, and a plurality of key mechanisms individually related to the rings for selectively causing said engagement and for varying said engagement for the production of dynamic effects.

17 Claims, 7 Drawing Figures

747500

MUSICAL STRINGED INSTRUMENT

BACKGROUND OF THE INVENTION

1. Field of the Invention

The present invention relates to musical stringed instruments, and more particularly to such instruments in which the musical sound of bowed stringed instruments is mechanically produced and which, additionally, provides dynamic effects not available in existing instruments.

2. Description of the Prior Art

Bowed musical stringed instruments of many varieties have, of course, been utilized from ancient times. However, the sounds of such instruments cannot be originated mechanically so that such sounds are only available from conventional bowed instruments when played by one skilled in such a performance or by mechanical reproductions of such performances by tape, record or the like. While attempts have been made to produce such sounds electrically, the results are obviously defective imitations rather than the actual sounds produced by conventional bowed stringed musical instruments.

Previous mechnically played musical stringed instruments are typified by the following U.S. Pat. Nos.:

Hockspeier, 680,485, Aug. 13, 1901;

Schmidt, 926,511, June 29, 1909;

Kidwell, 3,443,468, May 13, 1969.

The inventions disclosed in these patents are intended to produce the sound of plucked musical stringed instruments, as is clear from the usage in these patents of such terms as: "picker-wheel", "clear and distinct picking", "plectrum", "pluck the guitar's strings", and the like.

While it is desirable to provide musical instruments duplicating the sounds of conventional bowed musical stringed instruments, the limited range and dynamic effects available from these instruments lack interest in an era where musical sounds are produced and/or modified electronically. Obviously, however, the most desirable instrument would be one capable of selectively producing the sounds of conventional bowed stringed instruments as well as providing novel and unusual effects.

SUMMARY OF THE INVENTION

Accordingly, it is an object of the present invention to provide an improved musical stringed instrument mechanically duplicating or simulating the sounds of conventional bowed musical stringed instruments.

Another object is to provide such an instrument adaptable to existing musical stringed instruments.

Another object is to provide such an instrument playable by a keyboard, either by itself or in combination with another keyboard instrument such as an organ, allowing music for such instruments to be played by one unskilled in the playing of existing bowed stringed instruments as to provide a string section for large organs.

A further object is to provide such a mechanical instrument capable of producing dynamic effects such as "phasing".

A still further object is to provide great flexibility in the sounds produced by a single musical instrument such as the sounds of bowed or plucked stringed instruments as well as various dynamic effects selectively available for individual notes by manipulation of the key corresponding to each note.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
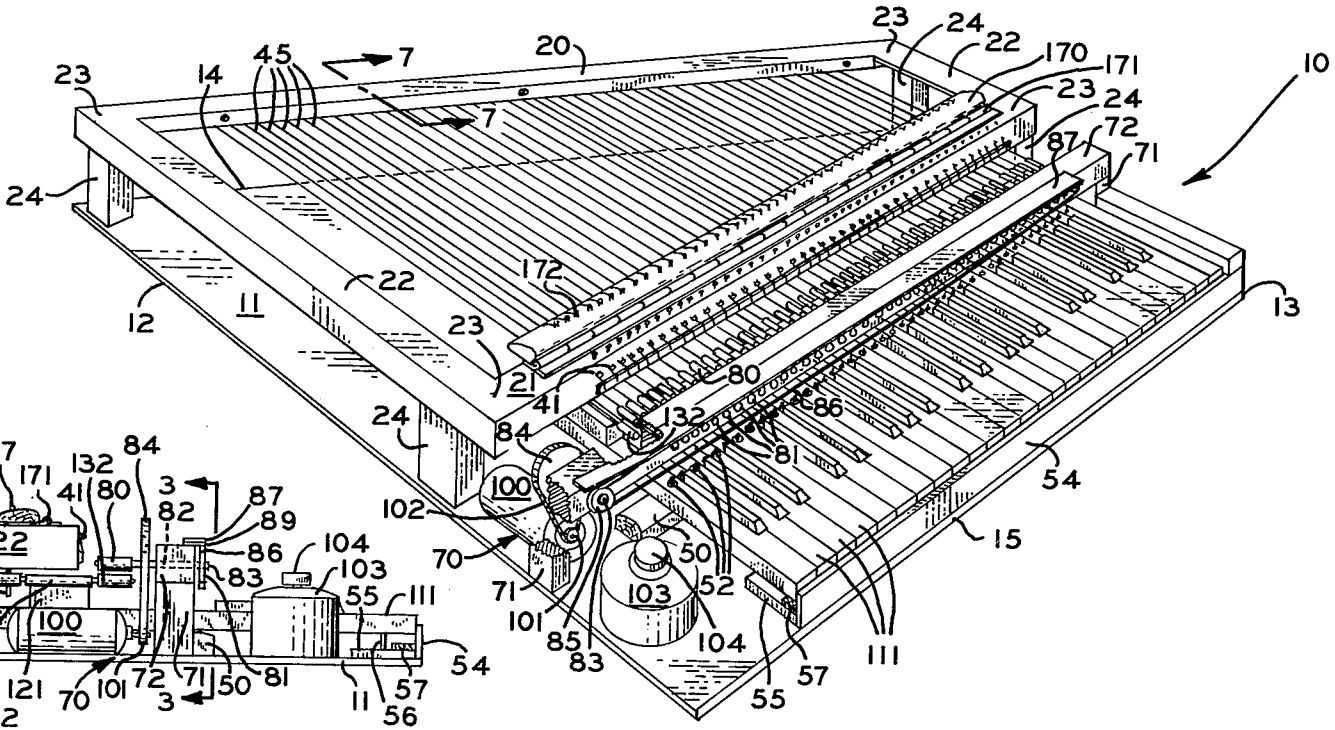
FIG. 1 is a perspective view of a keyboard musical stringed instrument embodying the principles of the present invention.

Referring more particularly to the drawings, in FIG. 1 there is shown a keyboard musical instrument 10 which embodies the principles of the present invention. The instrument has a trapezoidal, substantially planar bed 11 which can be placed on a table, not shown or any other desired support. The bed has a low note side 12, toward the bottom as viewed in FIG. 1, and an opposite, substantially parallel but shorter high note side 13. The substantially parallel and opposite sides 12 and 13 of the bed are interconnected by an angularly related tuning end 14 and an opposite, keyboard end 15 which is substantially perpendicular to the opposite sides 12 and 13.

Figure 4:
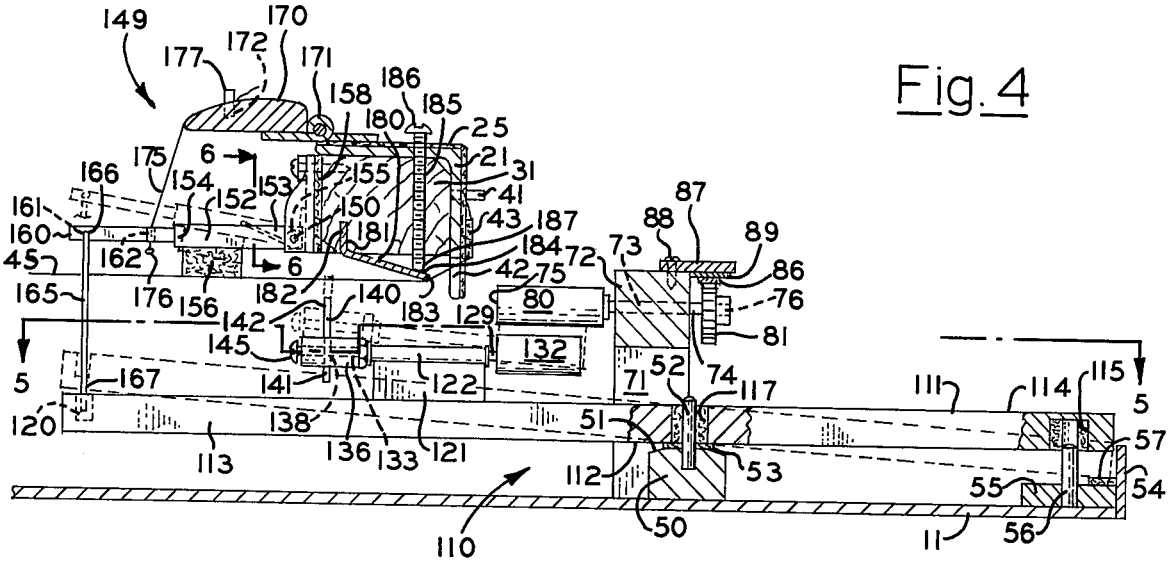
FIG. 4 is a fragmentary side elevation showing a key mechanism and elements associated therewith of the musical instrument of FIG. 1 in a retracted position, with an actuating position thereof indicated by dashed lines.
Figure 7:
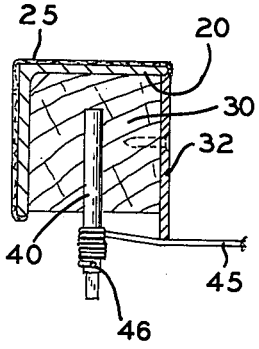
FIG. 7 is a section taken on line 7—7 of FIG. 1 showing a tuning pin of the instrument of FIG. 1 and elements associated therewith.

The instrument 10 has a tuning bridge 20 in an upwardly spaced parallel relation to the tuning end 14 of the bed 11 and has a hitch pin bridge 21 substantially parallel to the keyboard end 15 and centrally disposed between the keyboard end and the tuning end. The hitch pin bridge 21 is substantially parallel to the bed and upwardly disposed therefrom with substantially the same spacing as the tuning bridge. A pair of distance pieces 22 disposed substantially parallel to, respectively, the low note side 12 and the high note side 13 of the bed fixedly interconnect the corresponding ends of the tuning and hitch pin bridges. The intersections 23 of the bridges 20 and 21 with the distance pieces 22 are individually provided with first mounting blocks 24 fixedly interconnecting said bridges and distance pieces to the bed 11. Said bridges 20 and 21 and distance pieces 22 are constructed of angle iron, as best seen in FIG. 4, having the interior of the angle disposed downwardly of, and centrally toward, the bed. The exterior surfaces of the angle are covered with felt 25. As shown in FIG. 7, the interior angle of the tuning bridge 20 is fitted throughout its length with a tuning block 30 substantially filling said angle, and, as shown in FIG. 4, the interior angle of the hitch pin bridge 21 is fitted with a corresponding second mounting block 31. As best shown in FIG. 7, a substantially vertical tuning plate 32 is mounted in the tuning block 30 extending therealong on the side thereof disposed toward the hitch pin bridge 21. The tuning plate extends downwardly somewhat below the lower edge of the tuning block 30.

A plurality of tuning pins 40 are fitted into the tuning block 30, as shown in FIG. 7, for frictionally restrained rotational movement and extend axially from the tuning block toward the bed 11. A tuning pin 40 is provided for each note, forty-four in the instrument shown in FIG. 1, and the number of such pins can, of course, be varied as desired in accordance with the purpose and expense of the instrument. For reasons subsequently to be explained, a portion of the tuning block 30 at the end thereof adjacent to the low note side 12 of the bed is not provided with tuning pins, and the tuning pins are substantially equally spaced along the balance of the tuning block. As best shown in FIG. 4, a plurality of hitch pins 41 individually related to the tuning pins 40 are fixed in the hitch pin bridge 21 extending axially therefrom in substantially parallel relation to the bed 11 toward the keyboard end 15 thereof. A plurality of slots individually related to the hitch pins 41 are formed in the hitch pin bridge individually extending from a point adjacent to each hitch pin downwardly toward the bed 11. A first strip of felt 43 disposed substantially parallel to the bed 11 is mounted on the hitch pin bridge between the hitch pins and their respective slots 42. A plurality of vibrating strings 45 individually interconnect each tuning pin with its respective hitch pin and individually extend through the respective slots 42. The strings are connected to their respective tuning pins in the conventional manner, as best seen in FIG. 7, by insertion through a transverse bore 46 in the pin and by wrapping about the pin, and the strings are conventionally adapted for tuning by individual rotational movement of their respective tuning pins to tension their respective strings.

An elongated key block 50 is mounted on the bed 11 extending substantially parallel to the keyboard end 15 thereof and positioned between said keyboard end and the hitch pin bridge 21. The key block has a substantially arcuate convex surface 51 disposed away from the bed and curved about an axis disposed substantially centrally below and parallel with the key block. A plurality of key pins 52 individually related to the strings 45 are mounted on and extend axially upwardly from the central portion of the key block 50 in a row substantially parallel to the hitch pin bridge 21. Each key pin is individually positioned in a plane substantially perpendicular to the bed and intersecting its respective string. A plurality of felt washers 53 are individually fitted about the key pins adjacent to the key block 50. An end block 54 is mounted on the bed 11 and extends along the keyboard end 15 thereof and upwardly from the bed substantially above the key block. An elongated positioning pin block 55 is mounted on the bed juxtapositioned to the end block 54 and extending upwardly from the bed substantially equally with the key block 50. A plurality of key positioning pins 56 are mounted on and extend axially upwardly from the positioning block 55 in a row substantially parallel with the hitch pin block. Each key positioning pin is, similarly to its respective key pin 52, positioned in a plane perpendicular to the bed and intersecting its respective string 45. A second strip of felt 57 is mounted on the positioning block between the positioning pins 56 and the pin block 55 and is disposed substantially parallel to the end block 54.

Figure 3:
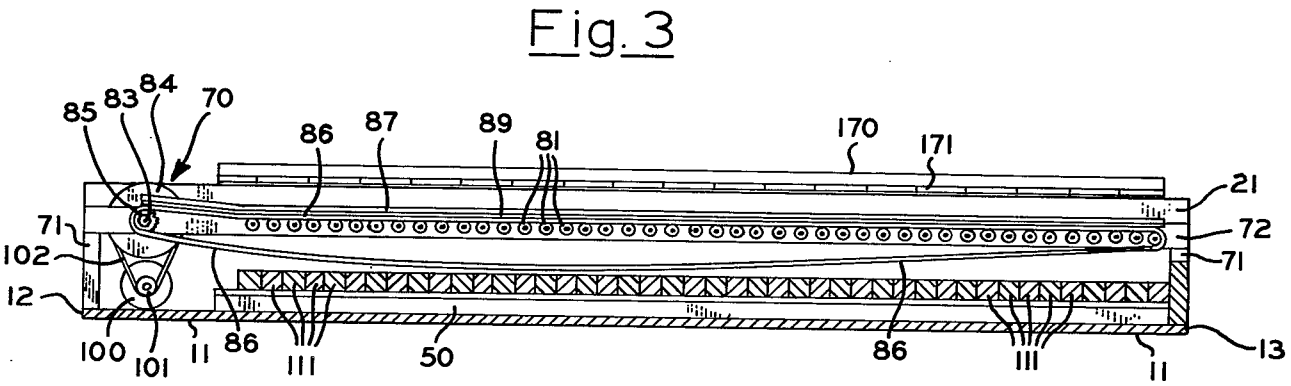
FIG. 3 is a section taken on line 3—3 of FIG. 2 showing a powered rotational drive system.
Figure 2:
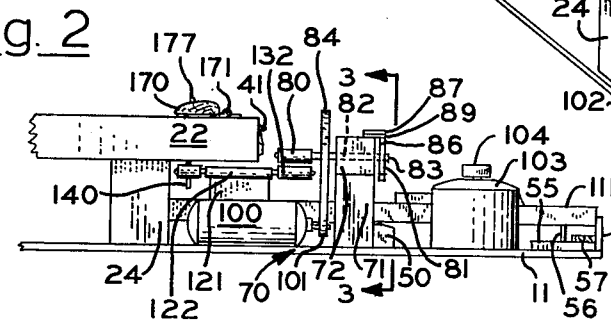
FIG. 2 is a fragmentary side elevation of the musical instrument of FIG. 1 showing a rotational drive system used therein.

The musical instrument 10 is provided with a powered rotational drive mechanism, indicated generally by the numeral 70 and best shown in FIGS. 2, 3, and 4. The rotational drive mechanism has a pair of opposite third mounting blocks 71 fixed on the bed 11, individually juxtapositioned to the opposite ends of the key block 50, and disposed, respectively, at the high note side 13 and at the low note side 12 of the bed 11. A drive bridge 72 constructed of brass or other bearing material is mounted on the third mounting blocks 71 and extends substantially parallel to and substantially upwardly of the key block 50. The drive bridge 72 is spaced upwardly of the bed 11 substantially equally with the hitch pin bridge 21.

A plurality of bearing bores 73 substantially parallel to the bed 11 and individually related to the strings 45 are formed in the drive bridge 72. Each bearing bore 73 is positioned in a plane substantially perpendicular to the bed and intersecting its respective string. A plurality of drive shafts 74 are individually rotationally mounted in the bearing bores 73. Each drive shaft 74 has a driving end 75 extending therefrom toward the hitch pin bridge 21 and an oppositely extending driven end 76. A plurality of drive friction rollers 80 formed of a resiliently flexible material, such as rubber tubing, are individually mounted on the driving ends 75 of the drive shafts 74 for rotational motion therewith. A plurality of first sprockets 81 are similarly individually mounted on the driven ends 76 of the drive shafts. A countershaft bearing bore 82 is formed in the drive bridge 72 toward the low note side 12 of the bed 11 substantially parallel to the bores 73. A countershaft 83 is mounted for rotational movement in the bearing bore 82 and extends oppositely therefrom. A larger countershaft sprocket 84 is mounted on the extension of the countershaft 83 extending toward the hitch pin bridge 21 for rotational movement therewith, and a small countershaft sprocket 85 is similarly mounted on the opposite extension of the countershaft toward the keyboard end 15 of the base. A first cogged drive belt 86 links the small countershaft sprocket 85 and the first sprockets 81 for simultaneous transmission of rotational drive from the small countershaft sprocket 85 to the first sprockets 81. As best shown in FIGS. 3 and 4, a strip of metal 87 is mounted on the drive bridge 72 by screws 88 and extends therefrom toward the keyboard end 15 of the bed 11 above the first sprockets 81. A strip of plastic material 89 is mounted on the metal strip 87 and disposed toward and closely adjacent to the sprockets 81. The strip of plastic material 89 is adapted to maintain the first cogged belt 86 in linking engagement with the upwardly disposed portions of said sprockets.

A variable speed electric motor 100 is mounted on the bed 11. The electric motor 100 rotationally drives an output sprocket 101 disposed substantially below the large countershaft sprocket 84 and having an axis substantially parallel to the countershaft 83. The electric motor 100 extends from the output sprocket 101 toward the tuning end 14 of the bed. A second cogged drive belt 102 links the output sprocket 101 of the motor with the large countershaft sprocket 84 for transmission of rotational drive from the output sprocket to the large countershaft sprocket. The electric motor 100 is of a type well known in the art whose rotational speed is proportional to the electrical voltage applied thereto. A variable voltage supply device 103 is conveniently mounted on the bed in the corner formed by the intersection of the keyboard end 15 and the low note side 12 thereof. The variable voltage supply device has a knob 104 rotationally mounted thereon and upwardly disposed therefrom for adjustment of the voltage supplied thereby. The electrical output of the voltage supply device is connected to the motor 100 for controlled variation of its rotational speed.

The motor 100, the voltage supply device 103, and the sprockets 81, 84, 85, and 101 are so selected and proportioned that the rotational speed of the drive friction rollers 80 may be varied for a purpose subsequently to be described from 0 to at least 25 revolutions per second. It will be apparent that any other drive arrangement, powered electrically or otherwise, may be provided for rotational drive of the drive rollers 80, or that a fixed speed drive may be utilized, if desired, with some sacrifice in performance.

Figure 5:
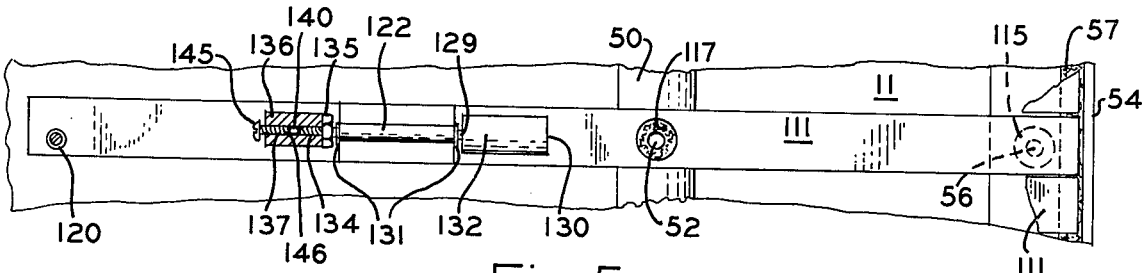
FIG. 5 is a section taken on line 5—5 of FIG. 4 showing a key of the mechanism of FIG. 4.
Figure 6:
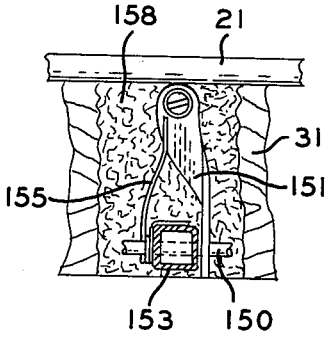
FIG. 6 is a section taken on line 6—6 of FIG. 4 showing a damper lever of the mechanism of FIG. 4 and elements associated therewith.

The musical instrument 10 is provided with a plurality of key mechanisms 110, best shown in FIG. 4 and FIG. 5, individually related to the strings 45. Each key mechanism has an elongated key 111 constructed of wood or other suitable material extending substantially parallel to its respective string. Each key 11 has a central or pivot portion 112 mounted on its respective key pin 52 and resting on its respective felt washer 53. Each key 111 has a support portion 113 extending from said pivot portion 112 toward the tuning end 14 of the bed 11 and disposed below and adjacent to its respective string, and has a finger portion extending oppositely from the pivot portion toward the end block 15 and terminating adjacent thereto above the second strip of felt 57. Each finger portion 114 of a key 111 has a conventional upwardly disposed surface adapted for engagement by a finger and has a first felt lined bore 115 fitted loosely to receive its respective key positioning pin 56. The pivot portion 112 of each key has a second felt lined bore 117 fitted to receive its respective key pin 52. The loose fit of the key about its key pin while resting on its respective felt washer 53 permits relatively limited rocking movement of the key about an axis substantially parallel to its respective string 45 and extending substantially through the felt washer and also permits relatively limited transverse movement of the key relatively to said string. The key, of course, has pivotal movement about an axis substantially parallel to the key block 50 when the finger portion of the key is depressed and released.

An upwardly open pushrod bore 120 is formed in the support portion 113 of the key 111 toward the end of the support portion which is disposed toward the tuning end 14 of the bed 11. The pushrod bore 120 is substantially perpendicular to the bed 11 and is disposed laterally of its respective string 45. A shaft mounting block 121 is fixed on the support portion of each key substantially below the hitch pin bridge 21. A tubular bearing 122 is fixed, as by gluing, on the shaft mounting block and disposed toward its respective string. Each tubular bearing 122 is disposed in a plane substantially perpendicular to the bed and intersecting said string with the axis of the tubular bearing substantially parallel to said string and below the axis of its respective drive shaft 74. The tubular bearing 122 extends toward the drive bridge 72 to a point adjacent to the end of its respective drive friction roller 80 which is disposed toward the hitch pin bridge and extends oppositely therefrom to a point substantially beyond the hitch pin bridge 21 toward the tuning end 14 of the bed 11. The weight of the support portion 113 of the key 111 together with that of other elements mounted on the support portion causes said support end of the key to be urged gravitationally toward the bed 11 into a released position, as shown in FIG. 4.

A key shaft 129 is received in each tubular bearing 122 and extends oppositely therefrom through a pair of opposite washers 131. The key shaft has a drive end 130 extending toward the drive bridge 72. A clutch friction roller 132 formed of rubber tubing or a similar material is mounted on the drive end 130 for rotational motion therewith. The key shaft has an oppositely extending mounting end 133 having male screw threads 134 formed thereon. The male screw threads 134 are engaged by a nut 135 which engages the corresponding washer 131 to secure the key shaft axially in its respective tubular bearing 122. A sleeve 136 having a longitudinal, axial bore 137 provided with female screw threads corresponding to the male screw threads 134 on the key shaft 129, is screw threadably engaged with the male screw threads 134 to substantially one half of the length of said sleeve for rotational movement of the sleeve with its respective key shaft. The sleeve 136 has a transverse bore 138 intersecting the axial bore 137 adjacent to and outwardly of the end of the key shaft 129 which has the male screw threads 134. A projection, or length 140 of resiliently flexible filamentary material, such as 20 pound test nylon fishing line, extends through the transverse bore 138 and radially from the sleeve for orbital movement thereabout. The length of filamentary material 140 has a mounting end 141 positioned within the transverse bore 138 and extends from said bore radially of the sleeve 136 to an opposite distal end or tip 142 adapted to move in an orbital path nearly engaging its respective string 45 when its respective key 111 is in the released position. Since the projections actuate their respective strings, they are sometimes referred to as "actuating means".

The key mechanism 110 is so proportioned that depression of the finger portion 114 of the key 111 pivots the key about its mounting on the key block 50 and moves the support portion 113 of the key together with its associated elements from the retracted position toward their respective strings 45 into an engaged position indicated in dashed lines in FIG. 4. In this engaged position, the clutch roller 132 of the key shaft 129 engages its respective drive roller 80 causing the key shaft to be rotationally driven by the power drive mechanism 70. Additionally, in the actuating position the mounting end 133 of the key shaft is positioned toward its respective string 45 so that the orbital path of the tip 142 of the length of filamentary material 140 engages said string.

The musical instrument 10 has a damper mechanism 149 having a damper shaft 150 disposed substantially parallel with the hitch pin bridge above the strings 45 and mounted on brackets 151 which are in turn mounted, preferably by screws, on the second mounting block 31. A plurality of damper levers 152, individually related to the strings 45 and preferably formed of rectangular tubing, have mounting ends 153 individually pivotally mounted on the damper shaft. Each damper lever 152 has a spiral spring 155 mounted about the damper shaft 150 and adapted to urge the distal end of the damper lever toward its respective string 45. A dampening pad 156 is mounted on the distal end of each damper lever disposed toward its respective string and adapted to engage said string for dampening the vibrations thereof when said distal end moves toward said string. A third felt strip 158 is mounted on the second mounting block between said mounting block and damper shaft 150. Each tubular damper lever 152 has an extension 160 of wood or other suitable material slidably fitted within the damper lever and extended therefrom to a point substantially above the pushrod bore 120 in its respective key 111. A bore 161 is formed in each extension 160 substantially parallel to the damper shaft 150 and above its respective pushrod bore 120 in the key. A sustain bore 162 substantially perpendicular to the bed 11 is formed in each extension 160 adjacent to the distal end 154 of the damper lever 152. An inverted L-shaped pushrod 165 has a first arm 166 extended within the bore 161 of the extension 160 of the damper lever 152 for pivotal connection thereto, and has a second arm 167 extended perpendicularly of its respective key 111 into the pushrod bore 120 thereof and adapted for engagement with the support portion 113 of the key to pivot the damper lever so as to disengage the dampening pad 156 from its respective string when the key is pivoted into the actuating position. The length of the second arm 167 is dimensioned so that it does not extend to the bottom of the pushrod bore 120 when the key is in the released position so that pivotal movement of the damper lever toward the string will be stopped by engagement of the dampening pad 156 with the string instead of by engagement of the pushrod with the key.

A sustain bar 170 is pivotally mounted, preferably by a hinge 171, on the hitch pin bridge 21 for movement about an axis substantially parallel to said bridge. The sustain bar extends from the hitch pin bridge toward the tuning end 14 of the bed 11 to a point substantially above the distal ends 154 of the damper levers 152 and extends parallel to the hitch pin bridge substantially above all of the strings 45. The hinge 171 is adapted to permit the sustain bar 170 to be gravitationally urged to a normal position substantially parallel to the strings, as shown in FIGS. 1 and 4, and to be pivoted to a raised, sustaining position by a pedal or lever mechanism, not shown. A plurality of cord bores 172 substantially perpendicular to the bed 11 and individually related to the damper levers 152 are formed in the sustain bar substantially above their respective damper levers. A plurality of damper cords 175 individually interconnect each bore 162 in the extension 160 of the damper lever with its respective bore 172 in the sustain bar 170. An end of each cord 175 extends through its respective bore 162 and engages its respective extension 160 by a knot 176 below the extension, and the opposite end of each cord is inserted into the bore 172 and secured therein by a peg 177 for convenient adjustment of the effective length of the cord. The effective length of each cord is adjusted so that raising the sustain bar 170 upwardly pivots all of the damper levers 152 under tension of their respective damper cords 175 and disengages the dampening pads 156 from their respective strings 45.

A plurality of resiliently flexible engagement bridges or strips 180, best shown in FIG. 4 and individually related to the strings 45, are mounted on the second mounting block 31 of the hitch pin bridge 21 disposed toward the strings 45. Each engagement strip 180 has a mounting portion 181 substantially perpendicular to the bed secured in a slot 182 disposed toward its respective string 45 in the second mounting block 31. Each engagement strip has a distal portion 183 angularly related to the mounting portion and extending to an end 184 engaging said strip adjacent to its respective hitch pin 41 below the hitch pin bridge 21. A plurality of engagement adjusting screws 185 individually corresponding to the engagement strips 180 screw threadably engage the second mounting block for axial movement toward and from the corresponding key shaft 129. Each engagement adjusting screw 185 has a head 186 extending above the hitch pin bridge and has an opposite end 187 adapted to engage its respective engagement strip 180 toward the distal end 184 thereof which engages its respective string 45 for movement of the distal end 184 together with the portion of the string 45 engaged thereby toward and from their respective key shaft 129.

OPERATION

The operation of the described embodiment of the present invention is believed to be clearly apparent and is briefly summarized at this point. The keyboard musical stringed instrument 10 of the present invention can, of course, be supported for playing in any desired manner or provided with a desired decorative enclosure, not shown. To play the instrument the electric motor 100 is energized and the variable voltage supply device 103 adjusted with the knob 104 to cause the rotational drive mechanism 70 to provide a rotational speed of the drive rollers 80 such that when a key 111 is moved into the actuating position, the tip 142 of the length 140 of filamentary material mounted on said key will move in orbital path for repeated engagement of its respective vibratory string 45 at a rate which will produce, in a manner subsequently to be described, a desired musical sound.

To produce a musical sound resembling that of a bowed string instrument it is essential that the orbital path of the tip 142 of the length of filamentary material 140 about the key shaft 129 not engage its respective vibratory string 45 to an extent greater than the diameter of said string when said string is at rest. The degree of such engagement with a string 45 can be coarsely adjusted when the rotational drive mechanism is stopped by first depressing the finger portion 114 of its respective key 111 to move the key into its actuating position. Then the respective clamping screw 145 is disengaged from the length of filamentary material; said length of material is slid in the transverse bore 138 of the sleeve 136 to obtain a desired approximate engagement; and the clamping screw again engaged with the filamentary material to maintain this approximate engagement. The rotational drive mechanism 70 is then energized and final adjustment of the engagement of the tip 142 of the length of material with its respective string is obtained by rotation of its respective engagement adjusting screw 185 to move the distal portion 183 of the engagement strip 180 together with the string 45 toward and from its respective key shaft 129 until the desired sound of a bowed stringed musical instrument is produced. Since this will alter the tension of the string 45, a slight retuning of the string with its respective tuning pin 40 is usually required.

When the depth of engagement of the string 45 by the length of filamentary material 140 and the speed of the rotational drive mechanism 70 are suitably adjusted, the instrument will produce a note duplicating that of a bowed, string musical instrument so long as the appropriate key 111 is depressed. However, the musical instrument of the present invention is also capable of producing a number of dynamic effects.

An effect which is produced simultaneously for all notes being sounded by the instrument is caused by varying the rotational speed of the motor 100 by utilizing the variable voltage device 103. When said speed is reduced so that each string 45 is engaged less than 20 times per second by its respective length 140 of filamentary material, a repeated plucking sound is produced which can, of course, be varied by further decrease of the rate of said engagement. As said rate of engagement is increased from 20 times per second, the sound produced gradually becomes that of a bowed musical stringed instrument and is substantially that of such an instrument when a rate of 25 engagements per second is reached.

Another effect can be produced simultaneously on all notes being sounded by use of the sustain bar 170. When this bar is not used, movement of a key 111 into the actuating position raises the support portion 113 of the key lifting the pushrod 120 and pivoting the damper lever 152 about the damper shaft 150 so that the dampening pad 156 is disengaged from its respective string 45 permitting vibrations thereof to be excited by repeated engagement by the length of filamentary material 140. When the key subsequently is pivoted into the retracted position, the dampening pad is again brought into engagement with its respective string by pivotal movement of the damper lever urged by the spring 155 when the support portion of the key ceases upwardly to press the pushrod. When the dampening pad so engages the string, the note being sounded by the string is immediately dampened. However, when the sustain bar 170 is pivoted upwardly on its hinge 171 the damper cores 175 are tensioned and, through the knots 176 bearing on the extensions 160 of the damper levers, simultaneously pivot all the damper levers so that the dampening pads 156 are disengaged from their respective strings and any vibrations of the strings die away gradually rather than being dampened when their respective keys are released.

Perhaps of even greater significance than the dynamic effects simultaneously produced on all notes being sounded, is the provision in the musical instrument of the present invention for dynamic effects of the sound produced during the sounding of an individual note by suitable manipulation of its respective key 111. First, the volume or level of the sound can be changed by varying the depth to which a length of filamentary material 140 engages its respective string 45 by allowing the finger portion 114 of its respective key 111 to rise slightly above the fully depressed position of said finger portion correspondingly lowering the support portion 113 to lessen said engagement of the string. This lessened engagement causes the string to be excited less energetically with a correspondingly lower level of sound thus providing, in effect, an individual level control for each note. The usefulness of the dynamic effect obtained by varying said engagement can be extended if the vibrations of the strings are picked up for electronic amplification by conventional magnetic or optical pickups. Such pickup and amplification may, of course, be utilized with the musical instrument of the present invention for any other desired purpose.

Another dynamic effect can be produced on an individual note by utilizing the relatively limited rocking movement provided each key 111 about an axis substantially parallel to its respective string and by utilizing the relatively limited movement provided said key transversely of said string. These movements can be induced by, respectively, off center and lateral pressure on the finger portion 114 of said key and result in movement of the support portion 113 of the key laterally of its respective string 45. This lateral movement of the support portion correspondingly moves the point of engagement of its respective string 45 by the tip 142 of length 140 of filamentary material laterally of the string so that the string is engaged at a somewhat different point in the orbital path of said tip. Since the string is so engaged at a different point in the orbital path the vibrations of the string subsequent to said movement are not in phase with those prior thereto, and the simultaneous presence of both sets of vibrations while the prior vibrations die out produces an effect known as "phasing" hitherto only produced electronically. This "phasing" effect along with the effect due to selectively variable depth engagement of a string 45 by its respective tips 142 are available in the musical instrument of the present invention to vary individually each note produced while it is being sounded.

Although the invention has been herein shown and described in what is conceived to be the most practical and preferred embodiment, it is recognized that departures may be made therefrom within the scope of the invention, which is not to be limited to the illustrative details disclosed.

Having described our invention what we claim as new and desire to secure by Letters Patent is:

1. A musical instrument comprising:

(A) a vibratory string;

(B) a resiliently flexible filament having a mounting end and an opposite tip adapted to engage the string for inducing vibrations thereof;

(C) means mounting the filament for movement in an orbital path in which the filament periodically engages the string and in which the tip passes substantially through the position occupied by the string when the string is at rest;

(D) powered means for rotating the filament in said orbital path; and (E) manually controlled means for moving said path relative to the string for selective engagement with and disengagement from the string by the filament, in which the mounting means includes a shaft having a portion adjacent to the string on which the filament is mounted; and the means for moving said path is a key mechanism having a support portion provided with a bearing receiving said shaft for rotational movement about an axis substantially parallel to the string, a finger portion, and a pivot portion connected to the support portion for pivotal movement of the support portion towards and from the string in response, respectively, to depression and release of the finger portion.

2. The musical instrument of claim 1 including means limiting movement of said orbital path by the manually controlled means toward the string to an engagement with the string by the filament not to exceed the diameter of the string when the string is at rest.

3. The musical instrument of claim 1 in which the pivot portion of the key mechanism is mounted for movement about an axis substantially right angularly related to the string for movement of the filament to and from engagement with the string and for limited rocking movement about an axis substantially parallel to the string to achieve a phasing effect.

4. A musical instrument comprising:

(A) a vibratory string;

(B) string actuating means including a projection adapted to engage the string for inducing vibrations thereof;

(C) powered means for rotating the actuating means in a predetermined orbit; and (D) manually controlled means for moving said orbit relative to the string for selective engagement with and disengagement from the string by the actuating means, in which the means for rotating the actuating means includes a shaft having a mounting end adjacent to the string on which the projection is mounted; and the means for moving the orbit is a key mechanism having a support portion provided with a bearing for receiving said shaft for rotational movement, a finger portion, and a pivot portion connected to the support portion for pivotal movement of the support portion towards and from the string in response, respectively, to depression and release of the finger portion.

5. The musical instrument of claim 4 which includes a damper mechanism having:

(A) a damper lever extending substantially parallel to the string and adjacent thereto disposed oppositely therefrom of the support portion having a distal end and an opposite mounting end;

(B) means pivotally mounting the mounting end of the damper lever for pivotal movement of the distal end toward and from the string;

(C) resilient means urging the distal end toward the string;

(D) a pad of dampening material mounted on the distal end and adapted to engage the string when the damper lever moves toward the string; and (E) a pushrod connecting the support portion of the key and the distal end of the damper lever and adapted to disengage the pad from the string when the support portion moves toward the string.

6. The musical instrument of claim 4 in which the actuating means is a length of resiliently flexible filamentary material; the mounting end of the shaft has a transverse bore adapted to receive the length of filamentary material and a longitudinal bore intersecting said transverse bore; and a screw which screw threadably engages the longitudinal bore and has an end adapted for clamping engagement of said length of filamentary material.

7. The musical instrument of claim 4 in which the actuating means has an end mounted on the shaft and an opposite tip extended substantially transversely of the shaft; the orbit described by said tip passes substantially through the position occupied by the string when the string is at rest; and the powered means rotates the actuating means for periodic engagement of the string at a rate sufficient to produce a musical sound resembling that of a bowed musical stringed instrument.

8. The musical instrument of claim 7 in which the key mechanism provides relatively limited movement of the support portion in a direction in substantially right angular relation to both the string and to the direction of movement of the support portion toward and from the string, in response to corresponding movement of the finger portion in a direction in substantially right angular relation to the direction of said depressing and releasing.

9. The musical instrument of claim 7 in which the key mechanism provides relatively limited rocking movement of the support portion about an axis substantially parallel to the axis of the shaft, in response to corresponding rocking movement of the finger portion about an axis in a substantially right angular relationship to the direction of said pressing and releasing.

10. The musical instrument of claim 7 in which the opposite ends of the string are individually anchored to opposite, spaced pins and the actuating means engages the string adjacent to one of said pins, and the instrument includes:

(A) an engagement bridge engaging the string between the pin and the position along the string at which the actuating means engages the string; and (B) means mounting the engagement bridge for selective positioning movement together with the portion of the string engaged by said bridge toward and from the mounting end of the shaft.

11. A keyboard string musical instrument comprising:

(A) a substantially planar bed having a predetermined tuning end and an opposite end;

(B) a hitch pin bridge fixed to the bed extending substantially parallel to the opposite end;

(C) a plurality of tuning pins mounted adjacent to the tuning end of the bed, a plurality of hitch pins mounted on the hitch pin bridge and individually related to the tuning pins, and a plurality of musical sound producing vibratory strings individually interconnecting the tuning pins and their respective hitch pins;

(D) a plurality of elongated, substantially parallel keys individually related to the strings, each key having an elongated support end portion disposed substantially parallel with and adjacent to its respective string, a central portion pivotally mounted on the bed for pivotal movement of the support portion toward and from said string, and a finger portion juxtapositioned to the finger portions of the other keys to form a keyboard so that depression and release of the finger portion thereof, respectively, moves the support portion toward and from said string;

(E) a plurality of key shafts individually rotationally mounted on the support portion of each key substantially parallel with and disposed toward its respective string for movement with said support portion toward and from said string, having a mounting end adjacent to said string and an opposite drive end;

(F) a plurality of string actuating means individually mounted on and extending transversely from the mounting ends of said key shaft for rotational movement therewith, with each actuating means adapted for engagement of its respective string when the support end of its respective key moves toward said string; and (G) powered drive means engaging the drive end of the key shafts for rotational drive thereof.

12. The musical instrument of claim 11 which includes a plurality of damper pads adapted individually to engage each string when its respective key is released and disengage the string when said key is depressed and which has sustain means adapted for simultaneously disengaging the damper pads from their respective strings.

13. The musical instrument of claim 11 in which:

(A) each actuating means has an end mounted on the key shaft and an opposite tip extended therefrom and moved in an orbital path thereabout during said rotational movement of the key shaft and said orbital path of the tip passes substantially through the position occupied by the string when the string is at rest;

(B) each key is mounted on the bed with limited rocking movement of the support portion thereof about an axis substantially parallel to its respective string in response to corresponding rocking movement of the finger portion of said key;

(C) each string is individually provided with an engagement bridge mounted on the hitch pin bridge engaging the string adjacent to its respective hitch pin and adapted for movement toward and from its respective key shaft; and (D) each engagement bridge is provided with a screw mounted on the hitch pin bridge and screw threadably engaging the hitch pin bridge for axial movement relative thereto toward and from the key shaft, and having an end engaging the engagement bridge for corresponding movement of the engagement bridge together with the portion of the string engaged thereby toward and from its respective key shaft.

14. The musical instrument of claim 11 in which the powered drive means is adapted for rotational, string engaging movement of the actuating means in which the strings are engaged at least 25 times per second by the actuating means.

15. The musical instrument of claim 11 in which the actuating means comprises a resiliently flexible filament.

16. The musical instrument of claim 11 in which the powered drive means comprises:

(A) a drive bridge mounted on the bed adjacent to the drive ends of the shaft;

(B) a plurality of substantially parallel drive shafts mounted for rotational movement on the drive bridge individually related to and substantially parallel with the key shafts, each having a driving end adjacent to the drive end of its respective key shaft and an opposite driven end;

(C) a plurality of drive rollers individually mounted on the driving ends of the drive shafts;

(D) a plurality of clutch rollers individually mounted on the drive ends of the key shafts, each adapted for frictional rotational drive engagement with its respective drive roller when the support portion of the key moves toward the string and disengagement from said drive roller when the support portion moves from the string; and (E) a power rotational drive mechanism interconnecting the driven ends of the drive shafts for simultaneously imparting rotational motion thereto.

17. The powered rotational drive mechanism of claim 16 which includes a selectively variable speed rotational power source.

* * * * *

UNITED STATES PATENT AND TRADEMARK OFFICE

CERTIFICATE OF CORRECTION

PATENT NO. : 4,106,386

DATED : August 15, 1978

INVENTOR(S) : Richard A. Rotramel; Charles Michael Fisher

It is certified that error appears in the above-identified patent and that said Letters Patent are hereby corrected as shown below:

Column 5, line 24, change the number "11" to ---111---.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*